US007616773B2

(12) United States Patent
Tipsmark et al.

(10) Patent No.: US 7,616,773 B2
(45) Date of Patent: Nov. 10, 2009

(54) COMMUNICATION DEVICE WITH RECEIVER ENCLOSURE

(75) Inventors: Claus Tipsmark, Smørum (DK); Jens Lundby, Smørum (DK)

(73) Assignee: Oticon A/S, Smørum (DK)

( * ) Notice: Subject to any disclaimer, the term of this patent is extended or adjusted under 35 U.S.C. 154(b) by 204 days.

(21) Appl. No.: 10/581,599

(22) PCT Filed: Nov. 30, 2004

(86) PCT No.: PCT/DK2004/000832

§ 371 (c)(1),
(2), (4) Date: Jun. 28, 2006

(87) PCT Pub. No.: WO2005/055652

PCT Pub. Date: Jun. 16, 2005

(65) Prior Publication Data

US 2007/0110270 A1 May 17, 2007

(30) Foreign Application Priority Data

Dec. 5, 2003 (DK) ..... 2003 01800

(51) Int. Cl.
*H04R 25/00* (2006.01)

(52) U.S. Cl. ..... 381/381; 381/330; 381/322; 381/386

(58) Field of Classification Search ..... 381/313, 381/322, 324, 330, 381, 312
See application file for complete search history.

(56) References Cited

U.S. PATENT DOCUMENTS

| | | | | |
|---|---|---|---|---|
| 3,359,377 | A * | 12/1967 | Rosenstand | 381/322 |
| 4,620,605 | A * | 11/1986 | Gore et al. | 181/135 |
| 4,870,688 | A * | 9/1989 | Voroba et al. | 381/322 |
| 5,204,917 | A * | 4/1993 | Arndt et al. | 381/324 |
| 5,895,607 | A * | 4/1999 | Sugino et al. | 252/511 |
| 6,041,128 | A * | 3/2000 | Narisawa et al. | 381/322 |
| 6,459,800 | B1 * | 10/2002 | Brimhall | 381/322 |
| 6,522,764 | B1 * | 2/2003 | Bøgeskov-Jensen | 381/330 |
| 6,549,634 | B1 | 4/2003 | Vonlanthen | |
| 6,751,326 | B2 * | 6/2004 | Nepomuceno | 381/322 |
| 7,460,680 | B2 * | 12/2008 | Saltykov | 381/324 |

FOREIGN PATENT DOCUMENTS

| | | |
|---|---|---|
| EP | 0453200 | 10/1991 |
| EP | 0466961 | 1/1992 |
| WO | 0169974 | 9/2001 |

OTHER PUBLICATIONS

Abstract of JP 7060777, dated Mar. 7, 1995 to Kozaburo Nakamura et al., Entitled, "Ultra Thin Enclosure for Electronic Appliance".

* cited by examiner

*Primary Examiner*—Curtis Kuntz
*Assistant Examiner*—Ryan C Robinson
(74) *Attorney, Agent, or Firm*—Dykema Gossett PLLC

(57) ABSTRACT

A communication device including a casing to be worn at the ear of a user, the casing including a microphone, a signal processing device, a receiver for delivering an audio signal to the user's ear canal, and a receiver enclosure, the receiver enclosure including wall parts forming part of the casing which in cooperation with detachable wall parts form the enclosure in an air tight manner for sound isolation of the receiver.

5 Claims, 4 Drawing Sheets

COMMUNICATION DEVICE WITH RECEIVER ENCLOSURE

AREA OF THE INVENTION

The invention concerns a communication device with a receiver enclosure.

BACKGROUND OF THE INVENTION

In modern communication devices like hearing aids or head sets there is a risk that the audio signal from the receiver will be transmitted through either the air or the structural parts like the casing to the microphone. If the microphone picks up the audio signal from the receiver, this can lead to serious feedback problems, and this puts a serious limitation on the output sound levels which the communication device may deliver to the user.

It is known from hearing aids to try to solve this problem by providing an enclosure inside the casing for the receiver, but this makes both assembly of the apparatus and exchange of the receiver cumbersome. Further, this is not always enough to eliminate the problem of feedback at high sound output levels from the receiver. The seriousness of the problems increases when the use of a vented receiver is desired. In the publication EP 0466961 a hearing aid is displayed wherein the receiver is mounted in an enclosure with side wall and where a lid part is provided. It is difficult to produce hearing aids with receiver enclosures of the above kind, as it is not a straight forward task to mount the receiver inside a receiver enclosure such that it is suspended without coming into contact with the surrounding walls and at the same time provide both sound communication with the surrounding and electrical leads for feeding an electrical signal to the receiver.

SUMMARY OF THE INVENTION

It is the object of the invention to provide a communication device wherein the problems of sound signals leaking from the receiver to the microphone are diminished and which is easy to produce.

This is achieved by a communication device wherein the receiver is suspended from the detachable wall parts and the receiver and the detachable wall part are allowed to be initially assembled as a sub-assembly, which is then introduced and mounted in the hearing aid as a unit. This provides easy and straight forward assembly of the tiny parts of suspension means, sound outlet, receiver and the detachable wall part before these items are introduced into the hearing aid and access is prohibited by the other close by parts of the hearing aid.

The suspension of the receiver is provided by means of a flexible tube leading from the receiver outlet to a sound delivering orifice in the detachable wall part, and by at least one further flexible suspension which is fastened to the detachable wall part. The two suspensions are easily provided as access is allowed from all sides. Further suspension means may be provided to prevent the receiver from moving and bouncing against the internal walls of the enclosure.

In a further embodiment of the invention electrical connection pins are provided which traverse the detachable wall part, such that soldering points on the receiver are connectable to the connection pins at one side of the detachable wall part in order that the signal processing device may serve an electrical signal at the receiver by gaining contact with the connection pins at the other side of the detachable wall part. In this way the subassembly of receiver and detachable wall part will also comprise the electrical connection to the receiver. Once placed inside the hearing aid, the receiver is contactable through the connection pins.

In an embodiment of the invention the wall forming part of the casing and/or the detachable wall part comprise a fibre-reinforced polymer. Such fibre reinforcement will ensure that the parts of the hearing aid will have a higher rigidity. Hereby, it becomes possible to use thinner wall parts and at the same time maintain sound-tightness of the enclosure. It is preferred to have a fibre content at around 50% by weigh. This allows fine details of the mould to be reproduced accurately ant at the same time the demands for temperature resistance and surface quality can be met.

Preferably a flexible gasket or packing is provided between the wall parts forming part of the casing and the detachable wall parts. The flexible packing is a both simple and very effective way of ensuring complete air tight sealing between the two wall parts. Other ways of sealing are possible like ultra sound welding or gluing, but they are less industrial than the use of a packing. By providing an air tight enclosure for the receiver, it is ensured that no sound will escape the enclosure, and even at very high sound pressures, there are no signs of feed back through the air from the receive to the microphone. When further such an air tight chamber for the receiver is provided, it is possible to use a vented receiver. The receiver has a movable membrane which produces the sound, where a first side of the membrane faces a first chamber which is in connection with the sound outlet and the second side of the membrane faces a second chamber. Usually the second chamber is closed, but in a vented receiver the second chamber has a vent opening to the surroundings. When using a vented receiver it is essential that the receiver be enclosed in an enclosure, which does not permit sound from the vent opening to leek outside the enclosure.

In a further embodiment the casing comprises a lower part shaped to lie behind the ear of a person and whereby the lower part has a bottom wall, two opposed side walls and an end wall whereby the detachable wall part is shaped to fit between the two side walls such that the enclosure is formed by the wall sections of the detachable part, the bottom wall, the two opposed side walls and the end wall. In this way the detachable wall part only need to comprise two adjacent wall sections and an easy assembly of the subassembly is facilitated as well as an easy insertion of the subassembly into the hearing aid.

In a further aspect the invention comprises a method for producing a hearing aid of the behind the ear type. Accordingly, a top shell part and a lower shell part are joined to form a hearing aid casing enclosing electrical components, whereby initially a receiver is fastened to a detachable wall part whereby a sound outlet orifice in the detachable wall part is connected to the sound outlet of the receiver, and where further electric connections between the receiver and through going connection pins in the detachable wall part are established whereafter the subassembly of receiver and detachable wall part is introduced into either top or lower shell part and fastened thereto to form an air and sound tight receiver enclosure.

By the use of the method according to the invention it is assured that a hearing aid with an air tight receiver enclosure which is an integral part of the casing can be made. This is not at all a trivial task. Firstly, the receiver case must be flexibly suspended within the enclosure and secondly both a sound outlet whereby the sound signal from the receiver can be guided to the exterior of the hearing aid must be provided, and electrical connections to the receiver made with flexible wires to ensure sound isolation must be provided. This is further complicated by all parts being tiny and an increasing demand that assembly process should be cost efficient. By firstly providing the subassembly of detachably wall part and receiver with receiver suspensions and the electrical connections it is assured, that these tiny parts may be assembled without impediment from the other parts of the hearing aid, which would otherwise make the placement of the receiver in the hearing aid very difficult. Naturally, the subassembly may be introduced in the top or the lower shell part according to the overall construction of the hearing aid.

DESCRIPTION OF A PREFERRED EMBODIMENT

Figure 1:
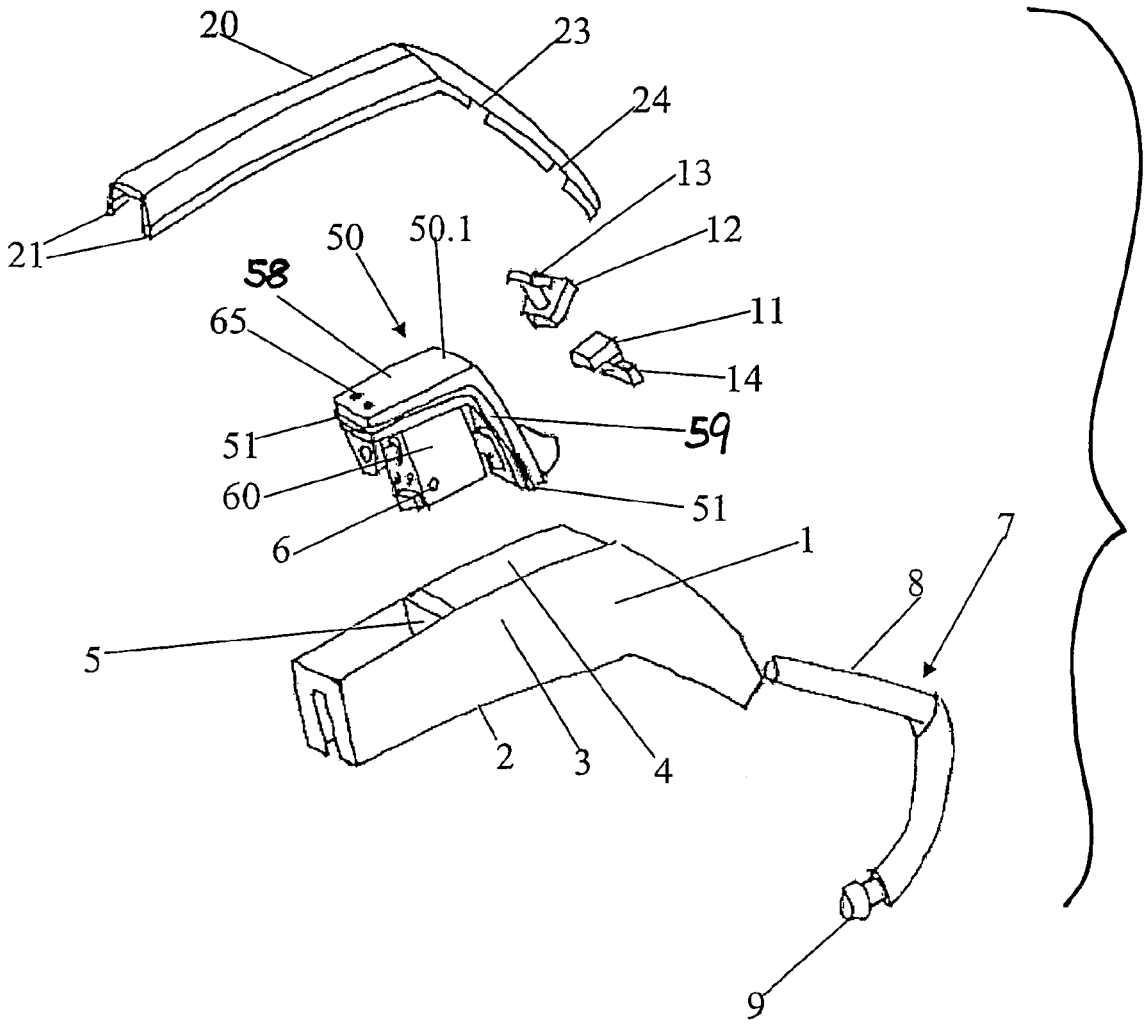
FIG. 1 shows an exploded view of a communication device according to the invention.

The exploded view of FIG. 1 displays the various parts of the hearing aid. The hearing aid comprises a bottom shell 1 and a top shell 20. When assembled the bottom shell 1 and the top shell 20 enclose a receiver assembly 50 and the microphones 11, 12. A hook 7 is insertable into the bottom shell 1 in order to provide a sound guide from the receiver 60 to the surroundings.

Figure 2:
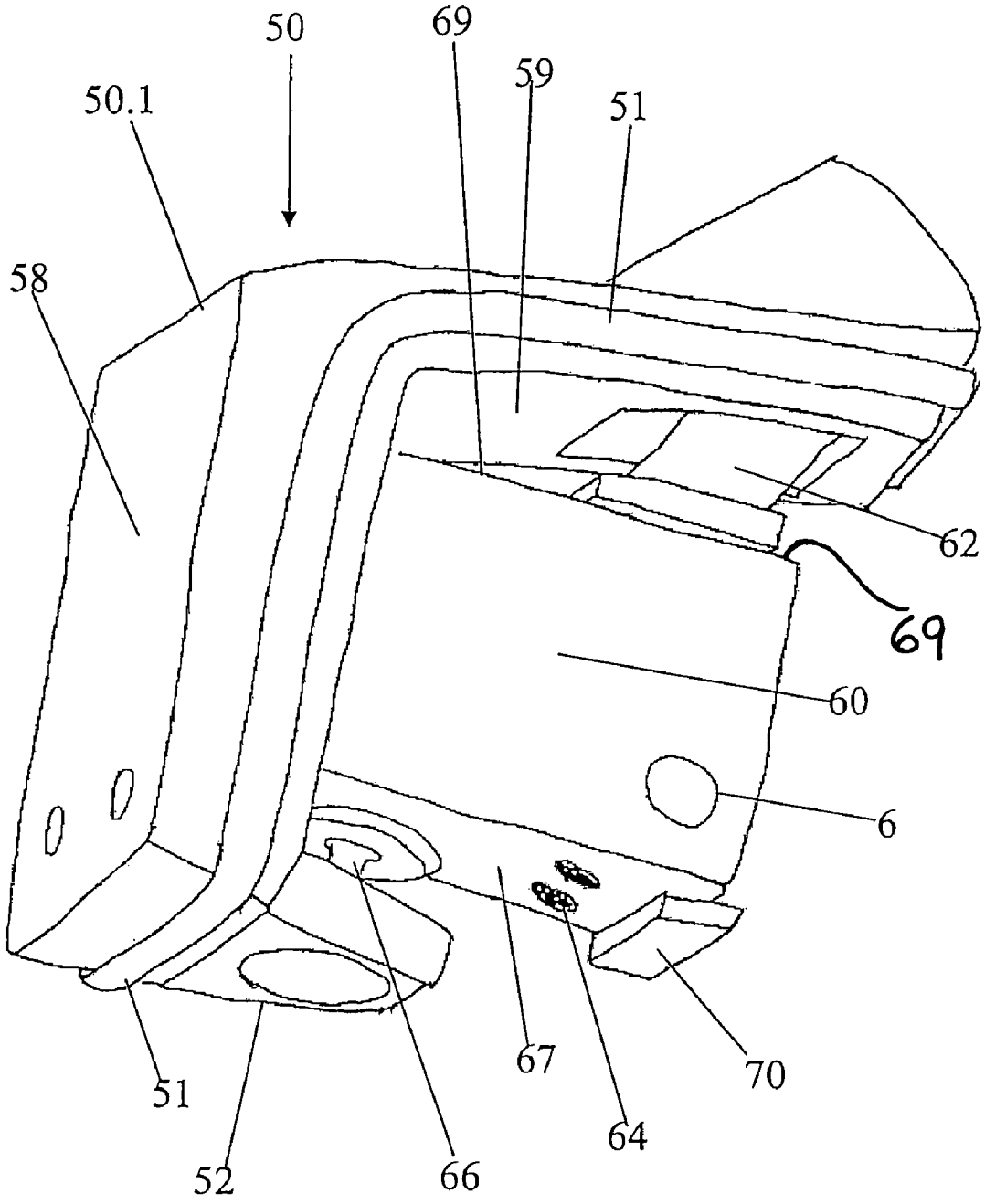
FIG. 2 shows the receiver assembly.
Figure 3:
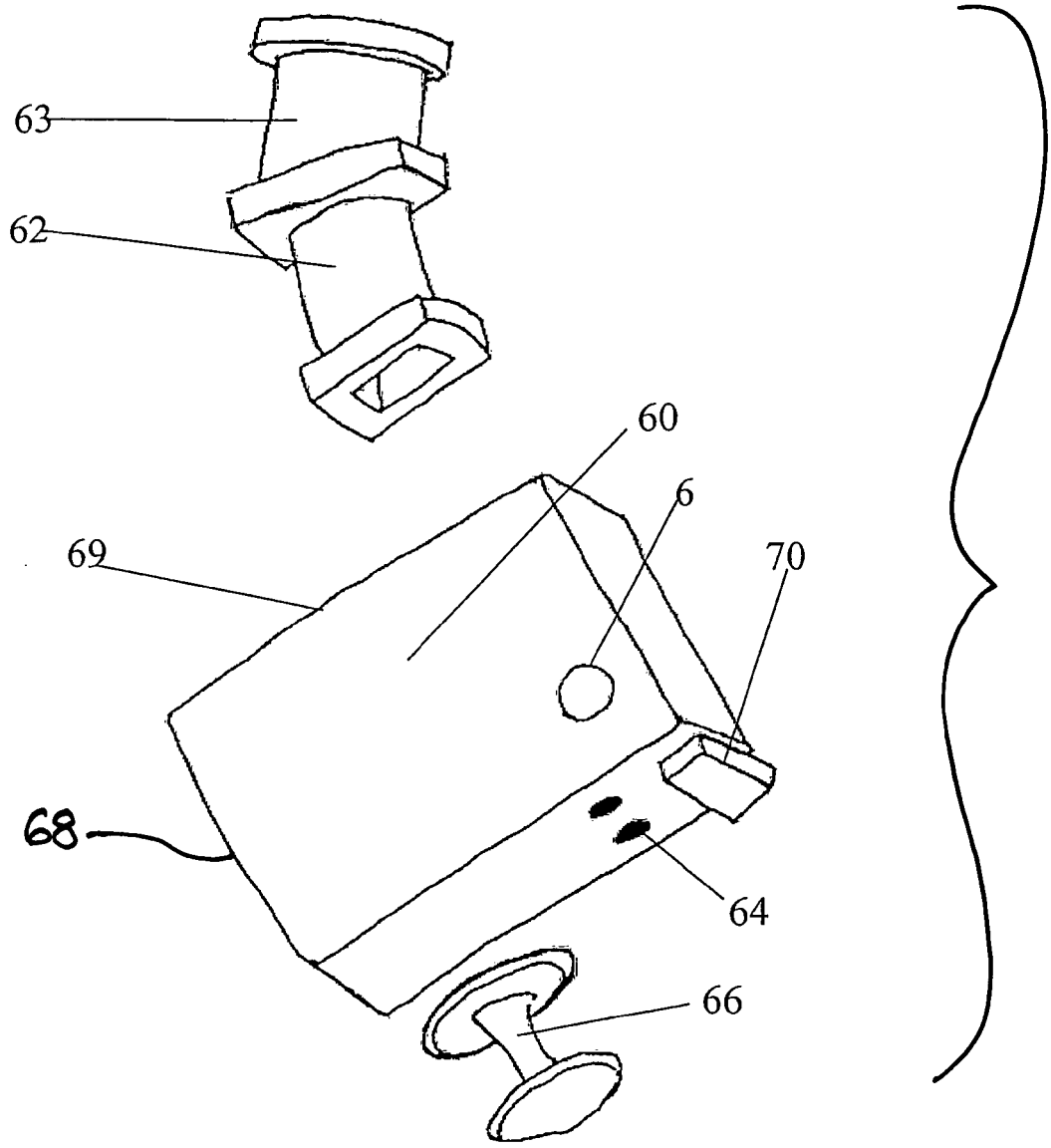
FIG. 3 shows an exploded view of the receiver with receiver suspension parts.
Figure 4:
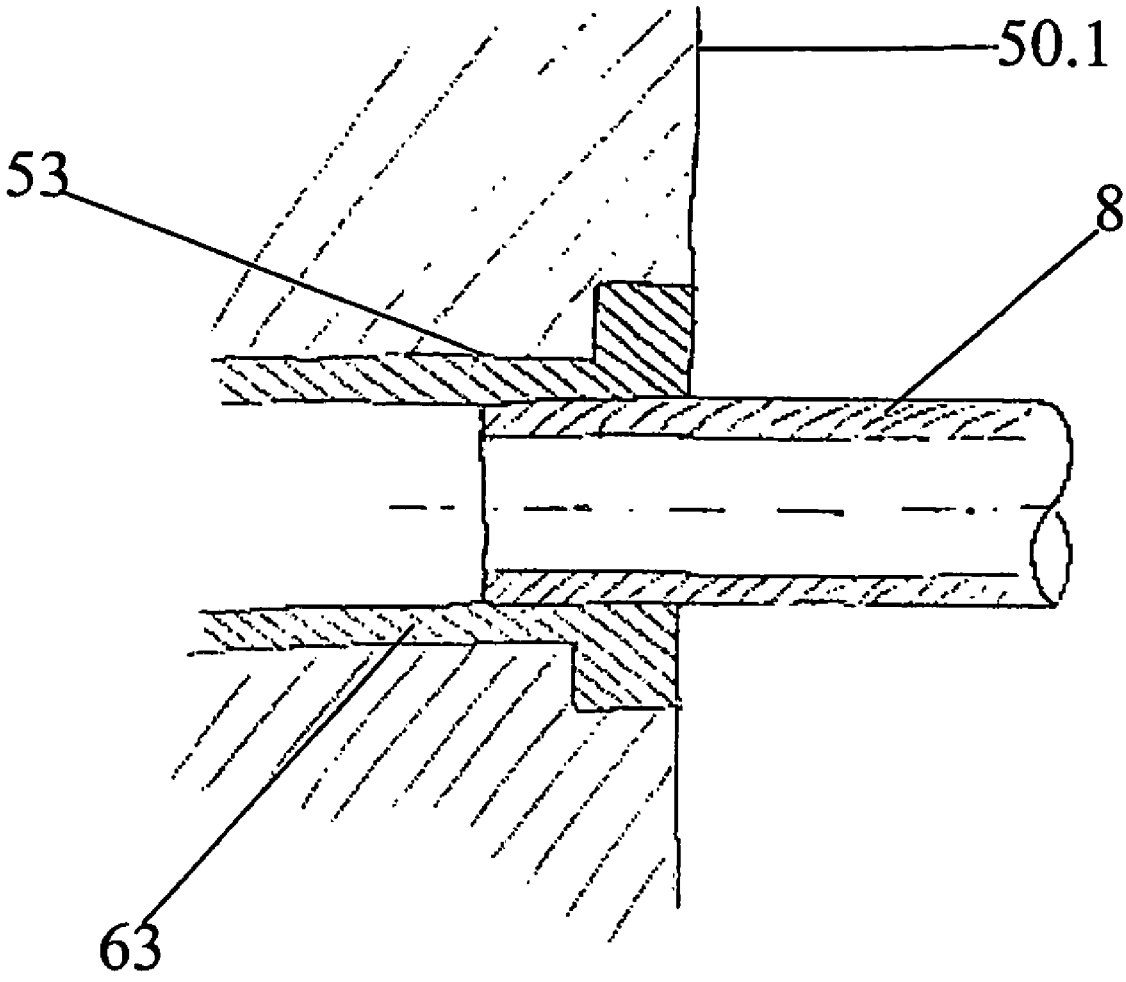
FIG. 4 is a cross section through the outlet from the receiver enclosure.

The receiver assembly 50 is described in more detail with respect to FIGS. 2, 3 and 4. The receiver 60 has a sound outlet opening (not visible) in a first side 69 and a flexible tube part 62 is coupled to the sound opening. The flexible tube 62 is shaped along with a tube 63 in order to form a combined sound outlet duct and receiver suspension part. At a side 67 the receiver has connection terminals 64 and also a further flexible suspension pole 66 is arranged at this side. The receiver assembly in FIG. 2 comprises the receiver 60 with suspensions 66, 62 and a receiver enclosure cover 50.1. This cover 50.1 has a first wall part 59 extending along the first side 69 of the receiver 60 and a second wall part 58 extending along the second side 68 of the receiver 60. From the second wall part 58 a beam 52 extends along the third side 67 of the receiver 60. The first wall part 59 has means for receiving and holding the tube 63, and the beam 52 has means for receiving and holding the pole 66. When the receiver is assembled to the receiver enclosure cover 50.1, the receiver is suspended by the pole 66 and the flexible tube 62. Both the tube 63 and the pole 66 extend through respective openings in the wall part 59 and the beam 52, respectively. The flexible tube 62 and the pole 66 are both made of a flexible polymer, such that the suspended receiver 60 may move in any direction. This helps to absorb any vibrations coming from the receiver or coming from handling the hearing aid, such that the receiver is vibrational isolated from the remaining hearing aid once assembled therewith.

As seen in FIGS. 2 and 3, a further shock absorbing means 70 is provided which prevents the receiver from bouncing on the internal walls of the enclosure.

In FIG. 1 it is shown how the receiver assembly may be placed in the bottom shell I of the hearing aid. The bottom shell comprises a bottom wall 2, two side walls 3,4 and a battery enclosure wall 5. These four walls together with the two walls 58, 59 of the receiver enclosure cover 50.1 form a receiver cabinet which is completely isolated from the remainder of the interior of the hearing aid. In order to achieve a sound tight seal between the wall parts of the hearing aid and the receiver enclosure cover 50.1, the receiver enclosure cover 50.1 has a flexible sealing material 51 placed along the edges of the first and second wall parts 58, 59.

The electric connection to the receiver 60 is accomplished by use of flexible wires, which are soldered to the connection points 64 and connected to connection pins 65 embedded in the wall part 58.

The hook 7 shown in FIG. 1 has a straight tube part 8 and a connection part 9. The straight tube part is to be inserted in the bottom shell 1 through an orifice and into the tube 63. In this way sound may be guided through tube 63, the straight tube part 8 and to the connection part 9. At the connection part 9 a flexible tube is to be connected to the hook in order to guide the sound to the ear of the user. As seen in FIG. 4, the receiver enclosure cover 50.1 has an opening 53, and the tube 63 is positioned inside this opening 53. The tube part 8 of the hook 9 is then placed inside the tube 63 and embraced by the inside surface of opening 53. In this manner it is ensured that sound cannot radiate from any radially-extending surface of the tube 63, as no radial part thereof extends outside the opening 53. Both the receiver casing and the sound path to the ear of the user are then seeled acoustically off from the remainder of the hearing aid and no sound will leak to the microphones and cause feed-back even at high output levels of the receiver. The hermetic receiver enclosure also provides the possibility to use a vented receiver. Such a receiver uses the inside of the receiver enclosure described as part of the back volume with respect to the receiver membrane and this provides the possibility of a better receiver performance. A vent opening 6 is shown in the receiver wall.

The receiver 60 and the microphones 11, 12 are connected by usual electrical circuitry (not shown) which also comprises a signal processing unit (not shown) and a battery. In the present embodiment a front microphone 11 and a back microphone 12 are shown, but one, three or more microphones may be employed. The electrical circuitry gains connection with the connection pins 65 which are embedded in the wall part 58 of the receiver enclosure cover 50.1.

The top shell 20 has and edge outline which matches the top edges of side wall 3,4 of the bottom shell part 1. Along the edge outline of the top shell 20 a sealing material 21 is placed. This sealing material 21 is interrupted at places 23, 24 in order that the microphone inlets 13,14 of the microphones 11, 12 may gain access to the surrounding. As seen in FIG. 1, the microphones 11, 12 are placed symmetrically in the centre of the hearing aid and the microphone inlets 13, 14 are open to both sides of the hearing aid, and thus the interruptions 23, 24 in the sealing material 21 of the top shell 20 are provided at both sides to accommodate the microphone inlets. In this way both the top-shell 20 and the microphone inlets 13, 14 will have the same shape for both right and left side hearing aids. If desired, the microphone inlets pointing towards the user's head when the hearing aid is placed on the ear may be filled out with a plug of suitable material. This can happen at the production facility or at the final dispenser, who sells the hearing aid to the end-user. Having the microphone inlets placed in the sealing line between the two shell parts has the further advantage that when the two shell parts are pressed together, a tight seal is obtained between the microphone inlets and the shell parts. This helps prevent penetration into the hearing aid of contaminating substances such as sweat or dust which otherwise could damage the delicate electronic parts of the hearing aid. This further helps to prevent sounds generated by the receiver inside the hearing aid casing from leaking into the sound inlet openings of the microphones. The two packing lines: the line between the two shell parts and the line between the receiver enclosure cover together assures that no sound will leak from the receiver and through the air reach the microphones. Also, the placement of the microphone inlets in the packing material renders the microphone inlets less visible, which lends more possibilities for agreeable designs of the hearing aid.

It should be noted that the receiver suspension described in detail here serves the purpose of isolating the receiver from the remainder of the hearing aid with regards to mechanical vibration transmitted through the casing wall, and this is a necessary requirement if the full benefit of the sound isolation between receiver and microphone inlets is to be enjoyed.

Preferably the sealing material at the sealing lines 51 and 21 are applied in a multi component injection moulding technique.

The receiver subassembly 50 of FIG. 2 is produced and may easily be placed in the bottom shell 2 as seen from FIG. 1. The receiver subassembly 50 may be held in place by suitable and well known click connections (not shown). Placement of the receiver 60 with suspensions 66, 62 in the receiver assembly cover 50.1 is done by drawing the tube 63 through the hole in the wall part 59 and likewise placing the pole 66 through the hole or slot in the beam 52. If the receiver should malfunction, it is easily exchanged. This is done simply by lifting the receiver assembly cover 50.1 out of the hearing aid and removing the connection wires from their connection points with the receiver. Thereafter, the receiver is easily removed from the receiver assembly cover, and a new receiver can be manually inserted to take its place. Soldering the connection wires to the new receiver is a formality.

Also, the suggested positioning of the microphone inlets in the parting line between the two shell parts provides possibility of very simple microphone suspension. Also, exchange of a microphone will be easy because the microphones are immediately accessible when the two parts of the hearing aid are taken apart. When the receiver is isolated from the rest of the hearing aid with respect to sound and vibration as described above, it becomes possible to suspend the microphone without the use of flexible suspension means as is otherwise the usual practice. This simplifies the hearing aid as fewer components are necessary.

The invention claimed is:

1. A hearing aid device which comprises:

a receiver assembly which includes a receiver that defines a first side, a second side and a third side, said third side being opposite said first side, said first side defining an outlet opening; a generally L-shaped cover which includes a first wall part that extends along said first side of said receiver, a second wall part that extends along said second side of said receiver, and a beam which extends away from said second wall part; a flexible extension pole which extends between said beam and said third side of said receiver, a flexible suspension tube which extends from an opening in said first wall part to said opening in said first side of said receiver, and a casing in which said receiver assembly is removably positioned, said casing including a top shell and a bottom shell, said flexible extension pole and said flexible tube part providing sound insulation for said receiver.

2. The hearing aid device as claimed in claim 1, wherein the enclosure consists of fibre-reinforced polymer.

3. The hearing aid device as claimed in claim 2, whereby the fibre-reinforced polymer contains 40%-60% by weight fibres.

4. The hearing aid device as claimed in claim 1, including a flexible gasket between the L-shaped cover and the receiver.

5. The hearing aid device as claimed in claim 1, wherein the lower shell has a bottom wall, two opposed side walls, and an end wall whereby the receiver assembly is shaped to fit between the two side walls such that an enclosure is formed by the L-shaped cover, the bottom wall, the two opposed side walls and the end wall.

* * * * *